United States Patent [19]

Kosakai

[11] 4,262,828

[45] Apr. 21, 1981

[54] SHOE REMOVER

[76] Inventor: Michiko Kosakai, 28-14, Ebaracho 2-chome, Nakano-ku; Tokyo, Japan

[21] Appl. No.: 61,502

[22] Filed: Jul. 27, 1979

[30] Foreign Application Priority Data

Nov. 13, 1978 [JP] Japan ..... 53-156570[U]
May 24, 1979 [JP] Japan ..... 54-69884[U]

[51] Int. Cl.[3] ..... A47J 51/02
[52] U.S. Cl. ..... 223/115
[58] Field of Search ..... 223/113-117, 223/120

[56] References Cited

U.S. PATENT DOCUMENTS

| | | | |
|---|---|---|---|
| 43,626 | 7/1864 | Richardson | 223/115 |
| 112,638 | 3/1871 | Rouard | 223/115 |
| 960,042 | 5/1910 | Seckendorff | 223/115 |
| 2,571,447 | 10/1951 | Hilton | 223/115 |
| 3,786,970 | 1/1974 | Dixon | 223/115 |

*Primary Examiner*—Werner H. Schroeder
*Assistant Examiner*—Andrew M. Falik
*Attorney, Agent, or Firm*—Steinberg & Raskin

[57] ABSTRACT

An improved shoe remover is provided. The shoe remover comprises a frame, a treading plate and a shoe-removing plate which are unfoldably fitted within the frame, respectively. First stopper apparatus is provided for locating the frame at a predetermined angle with respect to the treading plate when the treading plate is unfolded for making use of the shoe remover. Second stopper apparatus is provided for locating the shoe-removing plate at a predetermined angle with respect to the frame when the shoe-removing plate is unfolded for making use of the shoe remover. To use the remover, the two plates are rotated and unfolded until the frame is in upright position, and after shoes are taken off, the plates are rotated back to fit in the frame until the overall shape is thin and compact.

11 Claims, 12 Drawing Figures

SHOE REMOVER

BACKGROUND OF THE INVENTION

The present invention relates generally to a shoe remover, and particularly to a shoe remover which can be folded in a compact form when the shoe remover is stored or carried and which can be unfolded easily when making use of the same.

In general, a shoe remover of this type comprises a treading plate on which a wearer places one of his feet to keep the shoe remover in position by his weight, and a shoe-removing plate which holds the shoe covering the other foot in firm engagement while the foot is being twisted and pulled upward from the shoe to be taken off. Then, the positions of the feet are changed with each other on the plates and the same procedure is repeated to take the other shoe off.

Boots and high boots may fit the wearer's feet and legs so tightly that he may find it difficult to take them off without using the shoe remover. If one, therefore, uses the shoe remover to take his boots off, one must stand up with only one leg and so if the boots are high-heeled, he may easily lose his equilibrium and fall down. Therefore, the requirements for a convenient shoe remover are that it have a level and stable treading plate on which the wearer can safely place one of his feet, that it be applicable to both low-heeled and high-heeled shoes and boots, and that it be of simple construction that permits easy handling.

In this connection, FIG. 1 shows a conventional shoe remover wherein a treading section 1 and a shoe-removing section 2 are formed integrally as a plane board to which is attached a crosstie 3 for keeping the shoe-removing section 2 slightly distant from the floor. The shoe-removing section 2 has a notch 2*a* by which the heel 4 of a shoe is held when the foot is being pulled out. This type of shoe remover determines, however, the heel holding height by slanting the plane board. And the plane board can not be slanted at a very large angle without putting the wearer in an unstable posture while he is taking the shoes off. Consequently, the shoe remover of the conventional type can only be applied to low-heeled shoes. In addition, because the shoe remover is made of a one-piece plane board which is of relatively large size, it requires a large space not only for storage but also is awkward to hand carry.

SUMMARY OF THE INVENTION

Generally speaking, in accordance with the present invention an improved foldable shoe remover is provided. The shoe remover includes a frame which consists of two vertical sections and a top transverse section connecting the two vertical sections so that the frame has an open end. A treading plate is unfoldably fitted within the frame at a part in the vicinity of the open end of the frame. A shoe-removing plate is unfoldably fitted within the frame at a part in the vicinity of the top transverse section. A first stopper member is provided for determining the frame at a predetermined angle with respect to the treading plate when the treading plate is unfolded for making use of the shoe remover. A second stopper member is provided for determining the shoe-removing plate at a predetermined angle with respect to the frame when the shoe-removing plate is unfolded for making use of the shoe remover.

Accordingly, it is an object of the invention to provide an improved shoe remover which has a level treading plate on which the wearer can safely place one of his feet without losing his equilibrium while taking off the shoes.

Another object of the present invention is to provide an improved shoe remover which can be used for easy removing of not only low-heeled shoes but also high-heeled shoes.

A further object of the invention is to provide a foldable shoe remover which can be stored and carried in a compact form.

Still another object of the invention is to provide a shoe remover which permits a pair of shoes to be taken off without fouling the sole of the foot or socks or stockings.

A further object of the invention is to provide a shoe remover which is of simple and rugged structure and which can be handled easily.

Still other objects and advantages of the invention will in part be obvious and will in part be apparent from the specification.

The invention accordingly comprises an article of manufacture possessing the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the present invention, reference is had to the following description taken in connection with the accompanying drawings, in which.

DETAILED DESCRIPTION OF THE INVENTION

Figure 1:
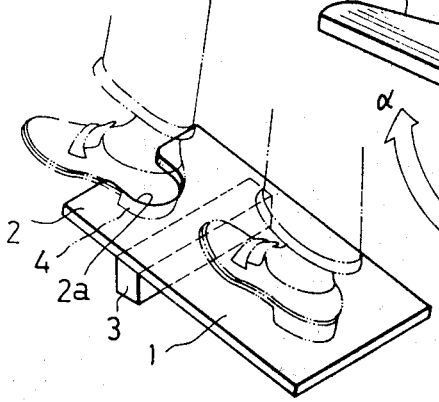
FIG. 1 PRIOR ART
FIG. 1 is a perspective view of the conventional shoe remover.
Figure 2:
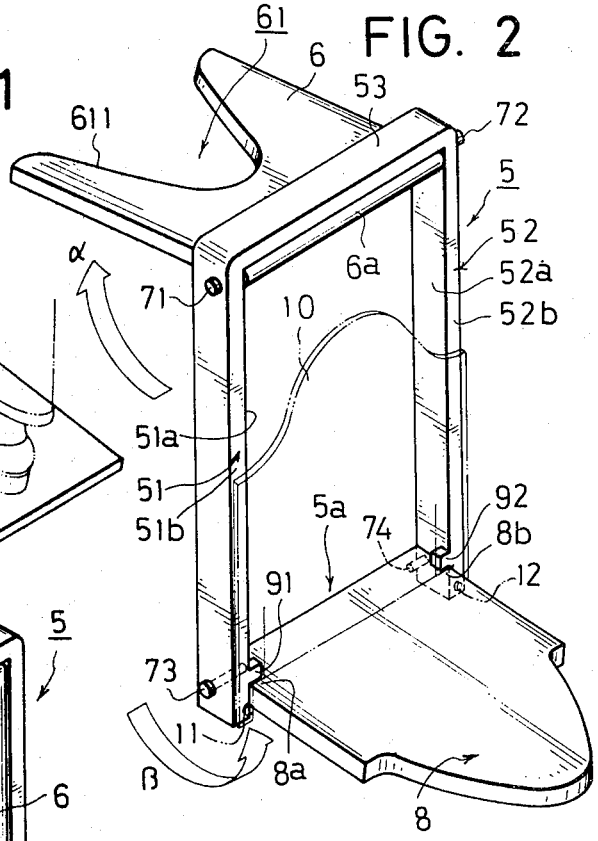
FIG. 2 is a perspective view illustrating one embodiment of the shoe remover according to the present invention.

Referring now to FIG. 2, an embodiment of the shoe remover according to the present invention is depicted in its unfolded state, wherein the reference numeral 5 shows a "U"-shaped rigid one-piece frame consisting of two vertical sections 51, 52 and a top transverse section 53 connecting the two vertical sections 51, 52. The frame 5 is suitably made of hard plastics or metal plate, such as low density polyethylene, middle density polyethylene, polypropylene and steel. The frame 5 has an open end 5*a* and has not transverse section that connects the two vertical sections 51, 52 on their bottom.

A shoe-removing plate 6 for holding a shoe (not shown) in place is mounted pivotally at the base portion 6*a* by pins 71 and 72 on the vertical sections 51, 52 of the frame 5 at a part in the vicinity of the top transverse section 53 of the frame 5 so that it can be fitted within the frame, when the shoe remover is folded. The shoe-removing plate 6 is formed with a notch 61 which consists of an arc portion 611 for holding and gripping the heel of a shoe (not shown) to be taken off.

A treading plate 8 is also mounted pivotally at the base portions 8*a*, 8*b* by pins 73 and 74 on the vertical sections 51, 52 of the frame 5 at a part in the vicinity of the open end 5*a* of the frame 5 so that it can be also fitted within the frame, when the shoe remover is folded. The treading plate 8 is unfolded until its base portions 8*a* and 8*b* come into contact with ribs 91 and 92 which are so formed as to project from the inner surface 51*a*, 52*a* of each of the vertical sections 51 and 52.

Figure 8:
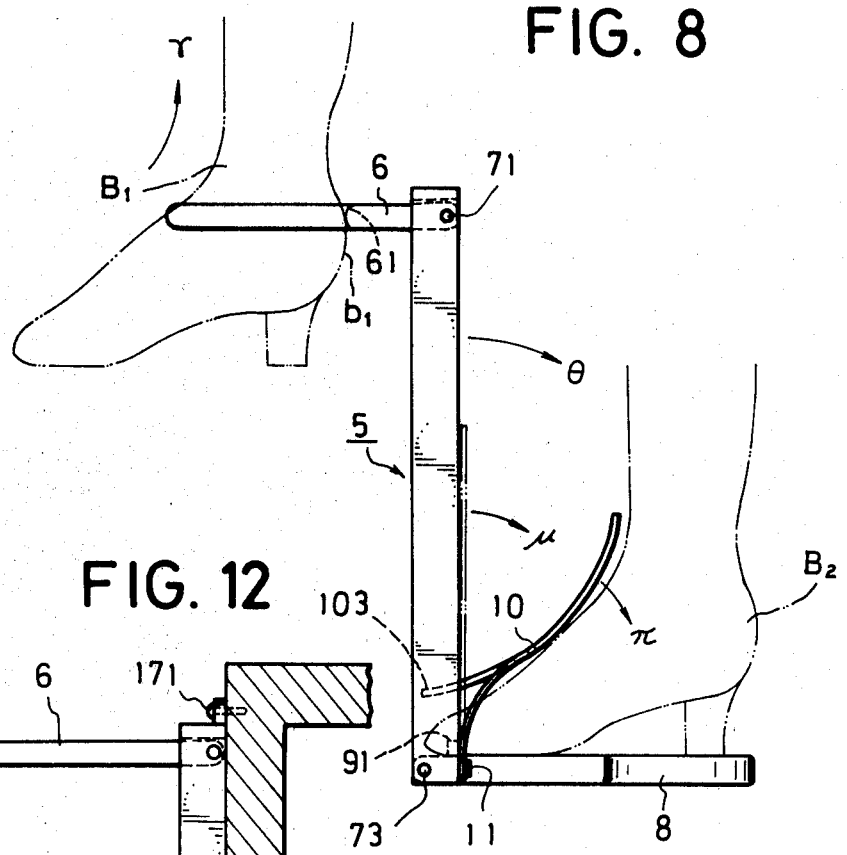
FIGS. 8 and 9 are each a side view showing how the shoe remover of the present invention is used to take shoes off.

In this embodiment, the ribs 91 and 92 are so positioned that when the treading plate 8 is unfolded the treading plate 8 makes substantially a right angle with the frame 5, as shown in FIG. 8. Thus, the ribs 91 and 92 together with the base portions 8*a* and 8*b* of the treading plate 8 function as a stopper member for locating or determining the frame 5 at a predetermined angle with respect to the treading plate 8 when the treading plate 8 is unfolded for making use of the present shoe remover.

Indicated by the two-dots-and-one-dash line is a cover 10 for the treading plate 8 which is a flexible thin sheet material made of cloth or plastic and which is bonded or fastened by screws 11 and 12 to the side surfaces 51*b* and 52*b* of the vertical sections 51 and 52 at its lower portion. The structure and function of the cover 10 will be described hereunder.

Figure 4:
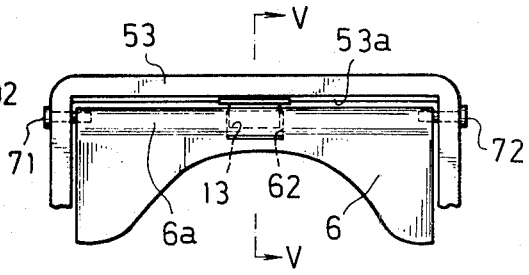
FIG. 4 is a front view, with part taken away, of one embodiment of the shoe remover according to the present invention.
Figure 5:
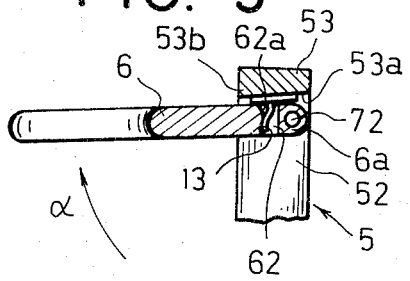
FIG. 5 is a cross-sectional view of FIG. 4 taken along the line V—V.

Turning now to FIGS. 4 and 5, FIGS. 4 and 5 illustrate an embodiment of the stopper member for the shoe-removing plate 6. The stopper member locates or determines the shoe-removing plate 6 at a predetermined angle with respect to the frame 5 when the shoe-removing plate 6 is unfolded for making use of the shoe remover.

The stopper member consists of a leaf spring 13 which is so secured to the inner surface 53*a* of the top transverse section 53 of the frame 5 as to project therefrom, a hole 62 with rounded portion 62*a* dug on the base portion 6*a* of the shoe-removing plate 6 and an edge portion 53*b* of the top transverse section 53.

When the shoe-removing plate 6 is unfolded in the direction indicated by the arrow $\alpha$ in FIG. 5, the leaf spring 13 slides into the hole 62 via rounded portion 62*a* and latches the shoe-removing plate 6 in such a manner that the plate 6 will form a predetermined angle with the vertical sections 51 (not shown) and 52 of the frame 5 and will not drop downward by gravity. The upward rotational movement of the shoe-removing plate 6 will be determined, by which the shoe-removing plate 6 comes into contact with the edge portion 53*b* of the top transverse section 53. More specifically, the shoe-removing plate 6 is held in such a position that it forms an angle with the vertical sections 51, 52 which permits easy removal of shoes. While it may be parallel to the horizontal line, it is preferably held with its forward end inclined downward at an angle of 5 to 30 degrees with the horizontal line. This will be attained by providing a downward projecting edge portion 53*b* of the top transverse section 53.

It is to be understood that the mechanism illustrated in FIGS. 4 and 5 is only one embodiment and that this invention allows for other modifications such as a leaf spring 13 attached to the inner surface 51*a*, 52*a* (FIG. 2) of the vertical section 51 or 52, or establishment of high frictional registance between the pivotal pins 71, 72 and the shoe-removing plate 6.

Figure 6:
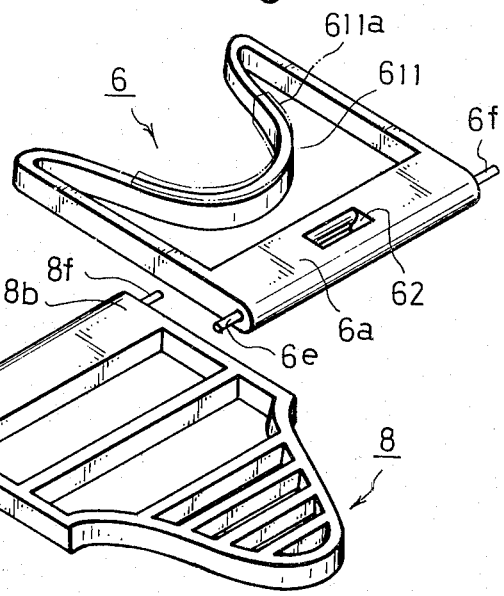
FIG. 6 is a perspective view illustrating another embodiment of each of the shoe-removing plate and treading plate of the shoe remover according to the invention.

FIG. 6 shows another embodiment of the shoe-removing plate 6 and the treading plate 8, wherein for materials saving and weight reduction, each plate is constructed of a frame-like structure which has substantially the same contour and achieves the same effect as the solid plate illustrated in FIG. 2, except that the arc portion 611 of the shoe-removing plate 6 is covered or coated with the protector 611*a* of soft material, such as synthetic rubber, sponge rubber and soft plastic for protecting the shoes from the damage and that the base portion 6*a* of the shoe-removing plate 6 and the base portion 8*a*, 8*b* of the treading plate 8 are provided, respectively at its both sides, with projecting pins 6*e*, 6*f* and 8*e*, 8*f* which are substituted for the pins 71, 72 and 73, 74, respectively. If this embodiment is applied, it will be understood that the frame 5 is formed at the corresponding portions with through holes into which the projecting pins 6*e*, 6*f* and 8*e*, 8*f* are inserted.

Figure 7:
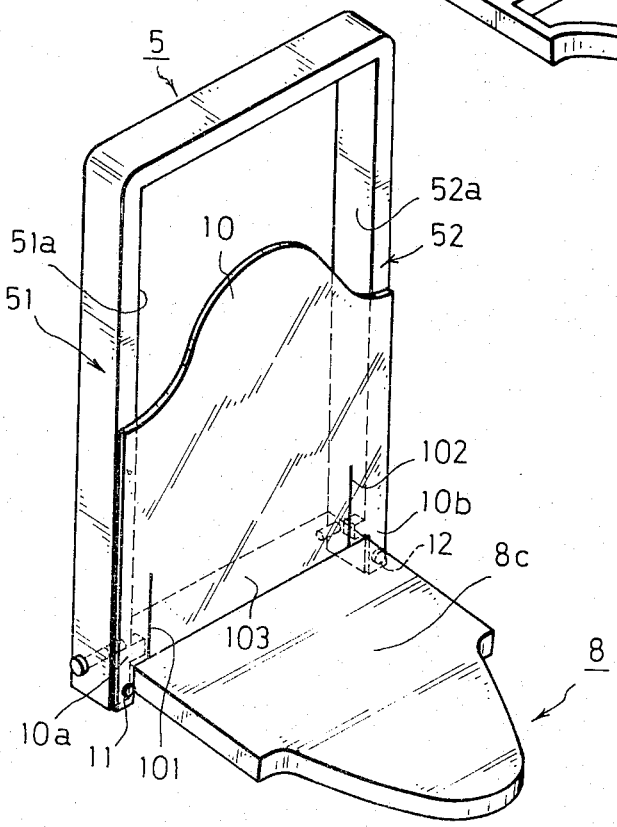
FIG. 7 is a perspective view, with part taken away, of the shoe remover according to the invention with a cover sheet attached to the frame.

Now, let us describe the structure and function of the cover 10 in detail with reference to FIGS. 2 and 7. When the frame 5 is in upright position as shown in FIG. 2, the cover 10 will bend by gravity to cover the treading plate 8. Therefore, to take shoes off using the shoe remover of this invention, the cover 10 is raised before one foot is put down on the treading plate 8 and the other foot is inserted within the notch 61 of the shoe-removing plate 6 to remove the shoe covering the foot, and thereafter, the positions of the feet are changed with each other on the plates 6 and 8 and the sole of the bare foot is placed on the treading plate 8 through the cover 10.

A preferred alternative to the above described structure is as follows. As shown in FIG. 7, while the two lower ends 10*a*, 10*b* of the cover 10 are fastened by screws 11 and 12 to the vertical sections 51 and 52 of the frame 5, respectively, the lower part of the cover 10 is provided with slits 101 and 102 in suitable locations slightly off the inner surface 51*a*, 52*a* of each vertical section 51, 52 toward the center of the cover 10, thereby forming a tongue 103. In this alternative embodiment, the cover 10 is made of a known material which is stiff enough to keep the cover 10 upright when the frame is in upright position. Thus, as will hereunder be described in detail, it is only when the tongue 103 is pressed by the toe of a foot that the cover 10 bends itself to cover the upper surface 8*c* of the treading plate 8.

Figure 9:
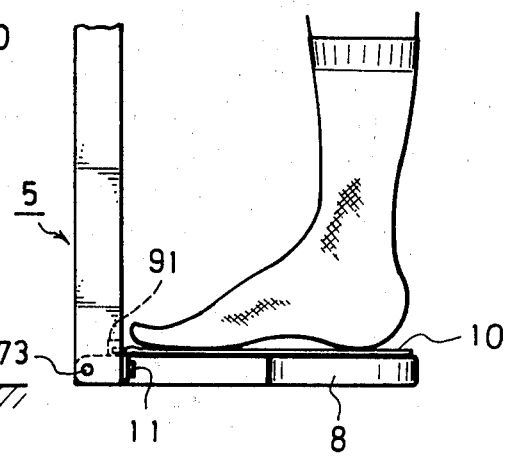

FIGS. 8 and 9 show how the shoe remover of this invention is used to take shoes off. While the shoe remover is in its unfolded state, a foot with a shoe $B_2$ is put down on the treading plate 8 so as to make the remover stable during its use. The shoe $B_1$ on the other foot is then pressed into the notch 61 formed in the shoe-removing plate 6, and with the shoe firmly gripped by the plate 6, the foot is pulled upward in the direction indicated by the arrow $\gamma$. As a result, the foot is pulled out of the shoe $B_1$ the heel $b_1$ of which is firmly gripped by the shoe-removing plate 6 and prevents upward movement of the shoe $B_1$. At the same time, the toe of the shoe $B_2$ presses against the tongue 103 formed by the slits 101 and 102 (FIG. 7) in the cover 10, the cover 10, therefore, falls in the direction of the arrow $\mu$. Subsequently, the positions of the feet are changed, with each other on the plates 6 and 8, and the bare foot is placed on the treading plate 8 to make the remover stable, while the shoe $B_2$ on the other foot is pressed into the notch 61 formed in the shoe-removing plate 6 to thereby remove the shoe from said other foot. Particularly, when the shoe $B_2$ is raised from the treading plate 8 for changing its position for the shoe $B_1$, the cover 10 falls further in the direction of the arrow $\pi$ until it covers the treading plate 8. Hence, by putting down the foot that has been pulled out of the shoe $B_1$ on this cover 10, fouling of the sole or sock or stocking can be effectively prevented. It is to be understood that the main object of the present invention can be achieved without using the cover 10.

When the foot is pulled upward in the direction indicated by the arrow $\gamma$ in FIG. 8, the frame 5 is under the effect of an external force working in the direction of the arrow $\theta$, but the frame 5 abuts against the treading plate 8 by means of the stopper member of the ribs 91 and 92, and so there is no possibility of the frame 5 falling in the direction of the arrow $\theta$ while shoes are being taken off.

Figure 10:
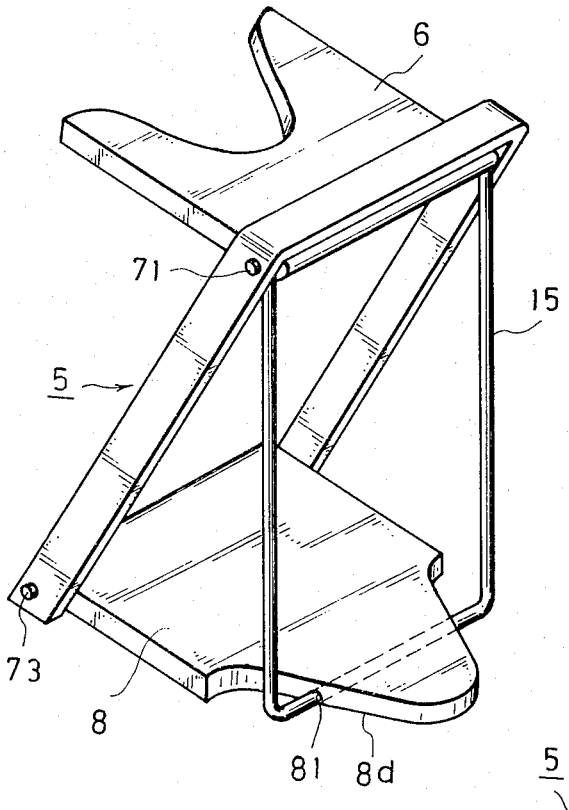
FIG. 10 is a perspective view illustrating another embodiment for holding the frame of the shoe remover in position.

In this connection, FIG. 10 shows another embodiment of the stopper member described above with reference to FIG. 2. According to this embodiment, a generally U-shaped supporting frame 15 is mounted pivotally by the pins 71 and 72 (not shown) to the frame 5, and a groove 81 is provided in a suitable portion of the bottom surface 8*d* of the treading plate 8. When the shoe remover is unfolded to its upright position as shown in FIG. 10, the supporting frame 15 is brought into engagement with the groove 81 so as to determine the relative position of the frame 5 and treading plate 8 while shoes are being taken off.

Figure 3:
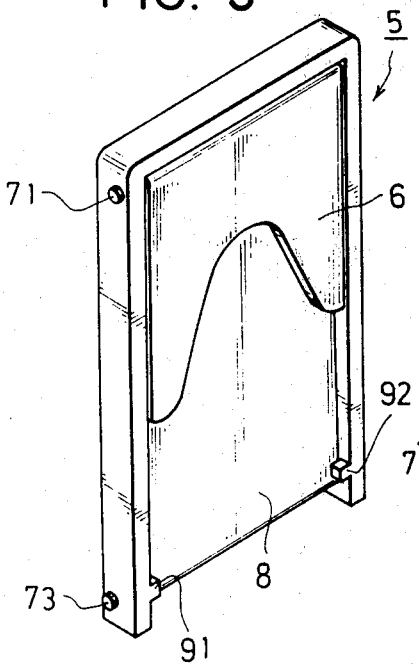
FIG. 3 is a perspective view showing the shoe remover of FIG. 2 in its folded state.

To put the shoe remover of this invention into a compact shape suitable for storage or transport, the shoe-removing plate 6 as shown in FIG. 2 is turned back in the direction opposite to that of the arrow $\alpha$ until it fits entirely within the frame 5, whereas the treading plate 8 is also turned back in the direction opposite to that of the arrow $\beta$ until it fits entirely within the frame 5. Accordingly, FIG. 3 shows the shoe remover with the shoe-removing plate 6 and treading plate 8 in their folded state. The treading plate 8 and shoe-removing plate 6 can be folded and unfolded without contacting each other by giving the forward end of the treading plate 8 a shape that corresponds to the curvature of the notch 61 in the shoe-removing plate 6.

Figure 12:
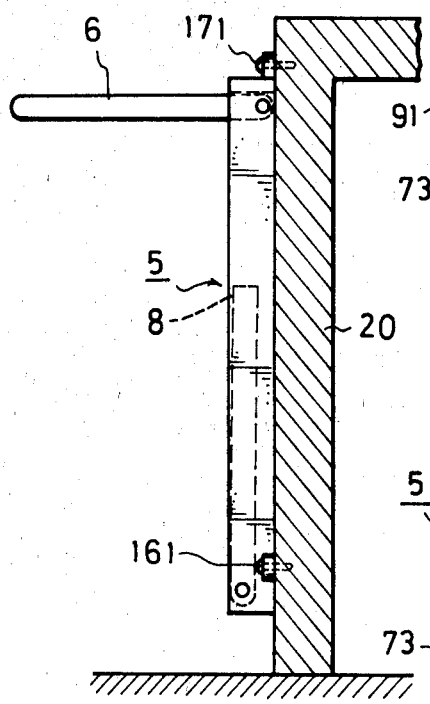
FIG. 12 is a side view showing how the shoe remover of the invention is installed on a structure for use as a remover of fixed type.
Figure 11:
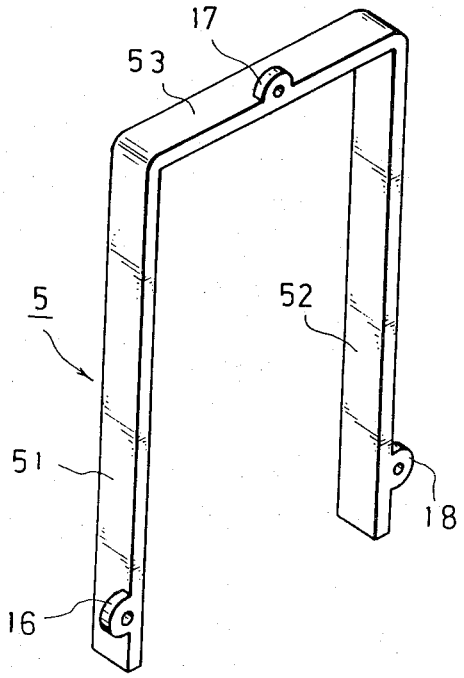
FIG. 11 is a perspective view illustrating another embodiment of the frame of the shoe remover according to the present invention.

FIG. 11 shows another embodiment of the frame 5 with mounting ribs 16, 17 and 18 provided on suitable points of the outer surface of the vertical sections 51, 52 and top transverse section 53, and FIG. 12 shows the use of the shoe remover of this embodiment as it is fixed by corresponding screws 161, 171 and 181 (not shown) to the side of vertical extention (riser) that joins the entrance floor (where shoes are to be taken off) and the elevation (no shoes are "allowed") leading to the hallway.

According to the shoe remover of this invention whose construction and operating principle has been described herein, the sections 51 and 52 of the frame 5 keep the shoe-removing plate 6 sufficiently high above the ground level to permit removal of not only low-heeled but also high-heeled shoes. In addition, it can be folded into a compact thin form that is suitable for storage.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a shoe remover including a foldable treading plate for putting down one of the feet thereon and a foldable shoe-removing plate having a notch for holding and taking off a shoe covering the other foot, the improvement which comprises:

a frame consisting of two vertical sections and a top transverse section connecting said two vertical sections so that said frame has an open end;

a treading plate secured so as to be unfoldable within said frame at a part in the vicinity of said open end of said frame;

a shoe-removing plate secured so as to be unfoldable within said frame at a part in the vicinity of said top transverse section;

first stopper means for locating said frame at a predetermined angle with respect to said treading plate when said treading plate is unfolded for making use of said shoe remover; and second stopper means for locating said shoe-removing plate at a predetermined angle with respect to said frame when said shoe-removing plate is unfolded for making use of said shoe remover.

2. A shoe remover as claimed in claim 1, wherein said treading plate is mounted pivotally at the base portion thereof by pins to said vertical sections of said frame.

3. A shoe remover as claimed in claim 2, wherein said shoe-removing plate is mounted pivotally at the base portion thereof by pins to said vertical sections of said frame.

4. A shoe remover as claimed in claim 3, wherein a cover made of a flexible thin sheet material is attached between said two vertical sections of said frame for covering the upper surface of said treading plate in its fully unfolded position.

5. A shoe remover as claimed in claim 4, wherein a part of said cover is provided at a part in the vicinity of said open end of said frame with two slits in the locations slightly off the inner surface of each transverse section toward the center of said cover.

6. A shoe remover as claimed in claim 4, wherein said treading plate and said shoe-removing plate have a frame-like structure, and said notch formed on said shoe-removing plate is partly provided with a soft material for protecting shoes from damage.

7. A shoe remover as claimed in claim 3, wherein said treading plate has a forward end, the shape of which corresponds to a contour of said notch formed on said shoe-removing plate so that said two plates may not contact each other in their folded state.

8. A shoe remover as claimed in claim 3, wherein said first stopper means comprises a U-shaped supporting frame pivotally mounted to said frame and a groove formed on the bottom surface of said treading plate for engaging with said supporting frame when the treading plate is unfolded to its upright position.

9. A shoe remover as claimed in claim 1, wherein said first stopper means comprises ribs so formed as to project from each of said vertical sections of said frame and the base portion of said treading plate which may come into contact with said ribs.

10. A shoe remover as claimed in claim 1, wherein said second stopper means comprises a hole formed on the base portion of said shoe-removing plate, a leaf spring which projects from said top transverse section of said frame to slide into said hole and an edge portion of said top transverse section of said frame.

11. A shoe remover as claimed in claim 10, wherein said hole is provided with rounded portion through which said leaf spring slides into said hole.

* * * * *